US006100601A

United States Patent [19]

Baker et al.

[11] Patent Number: 6,100,601

[45] Date of Patent: Aug. 8, 2000

[54] MEASUREMENT OF TONER LEVEL EMPLOYING SENSOR ON PADDLE

[75] Inventors: Raymond Milton Baker, Lexington; Ronald Paul Bussiere, Richmond; John William Hutchinson, Lexington, all of Ky.

[73] Assignee: Lexmark International, Inc., Lexington, Ky.

[21] Appl. No.: 09/372,013

[22] Filed: Aug. 11, 1999

[51] Int. Cl.[7] ..... G03G 15/08

[52] U.S. Cl. ..... 290/290 V; 399/27

[58] Field of Search ..... 399/27, 254; 73/290 V; 310/330, 366

[56] References Cited

U.S. PATENT DOCUMENTS

| | | | |
|---|---|---|---|
| 5,034,648 | 7/1991 | Gastgeb | 210/330 |
| 5,216,462 | 6/1993 | Nakajima et al. | 73/290 V |
| 5,634,169 | 5/1997 | Barry et al. . | |
| 5,864,431 | 1/1999 | Christensen . | |
| 6,009,285 | 12/1999 | Barry et al. | 399/27 |

FOREIGN PATENT DOCUMENTS

| | | |
|---|---|---|
| 354116961 | 9/1979 | Japan . |

*Primary Examiner*—Hezron Williams
*Assistant Examiner*—Michael Cygan
*Attorney, Agent, or Firm*—John A. Brady

[57] ABSTRACT

The level of powdered toner in a toner reservoir of a printer or copier is determined by ascertaining the time that it takes a stirring paddle to rotate from a second of two fixed ridges adjacent the top of the reservoir until the toner is engaged. A sensor, which is preferably a piezoelectric element or a strain gauge, is preferably mounted on the end of the stirring paddle to engage each of the two fixed ridges. When the sensor flexes after engaging each of the ridges, two closely spaced electrical pulse are produced. When the sensor engages the toner, another electrical pulse is produced, and the time between the second and third pulses is used to determine the level of the toner in the toner reservoir. If the stirring paddle is flexible, it may engage the ridges and the toner so that the sensor could be mounted on the stirring paddle to not engage the ridges or the toner but only to sense flexing of the stirring paddle for producing the electrical pulses. Instead of using the ridges, an emitter wheel may be employed to produce a pulse when the stirring paddle is in its substantially vertical position.

26 Claims, 3 Drawing Sheets

MEASUREMENT OF TONER LEVEL EMPLOYING SENSOR ON PADDLE

FIELD OF THE INVENTION

This invention relates to a method and device for measuring the level of toner in a printer or copier and, more particularly, to a method and device for determining the level of toner in a toner reservoir in accordance with the time required for a rotary element to rotate from a predetermined or first position until the toner is engaged due to rotation of the rotary element.

BACKGROUND OF THE INVENTION

It has been previously suggested in U.S. Pat. No. 5,862,431 to Christensen to measure the level of powdered toner in a toner reservoir of a printer or copier utilizing the electrophotographic, ionographic, or magnetographic technology. One embodiment of the aforesaid Christensen patent has a plurality of fixed piezoelectric film elements mounted in vertically spaced relation in a powdered toner reservoir of a replaceable cartridge.

When the reservoir is full, each piezoelectric film element is immersed in the powdered toner in the toner reservoir. The powdered toner greatly restrains mechanical movement of each of the piezoelectric film elements. Thus, the level of the resulting vibration of each of the piezoelectric film elements is detected by a sensing circuit to determine whether the powdered toner is present in the toner reservoir adjacent the specific piezoelectric film element.

Another embodiment of the aforesaid Christensen patent utilizes a single elongated piezoelectric element. The elongated piezoelectric element has its ends fixed to the top and bottom of a housing forming the toner reservoir. Its resulting vibration varies as the level of the toner decreases.

In either arrangement of the aforesaid Christensen patent, the volume of the toner reservoir in which a stirring paddle can rotate to stir the powdered toner is limited. Accordingly, the possibility exists that the powdered toner may not be stirred sufficiently in all locations in the toner reservoir to produce quality print over a period of time because of the tendency of the powdered toner particles to adhere to each other when not stirred.

U.S. Pat. No. 5,634,169 to Barry et al discloses another arrangement for measuring the level of powdered toner in a toner reservoir of a printer or copier. The aforesaid Barry et al. patent has a stirring paddle on a shaft, which is driven by a driving motor through a torsion spring. As the paddle is rotated through the powdered toner in a reservoir, its shaft lags the rotation of the driving motor. This difference in the angular displacements of the paddle shaft and a driving gear of a gear train driven by the motor indicates the lag of the paddle shaft because of the powdered toner in the reservoir.

The lag number, due to the difference in the amounts of angular displacements of the paddle and the gear of the gear train, decreases as the level of the powdered toner in the reservoir decreases. Three different lag numbers are obtained during each revolution of the paddle shaft by the use of an encoder wheel on the opposite end of the paddle shaft from its connection to the driving motor.

The largest of the three lag numbers indicates the greatest resistance encountered by the paddle in rotating through the powdered toner. The largest lag number indicates which look up table in a ROM is to be employed to provide an indication of the amount of the powdered toner remaining in the toner reservoir.

SUMMARY OF THE INVENTION

The method and device of the present invention are able to ascertain the actual level of the powdered toner in the toner reservoir at substantially all levels of the powdered toner while the stirring paddle is capable of rotating through substantially all of the powdered toner in the toner reservoir during each revolution of the stirring paddle. This is accomplished through mounting a sensor on the stirring paddle so that each flexing of one of the sensor or the stirring paddle is sensed by the sensor. Thus, there is no required structure that reduces the volume of the toner reservoir in which the stirring paddle can rotate as in the aforesaid Christensen patent.

In one embodiment, the sensor is disposed on the stirring paddle so that the sensor engages at least one fixed element at a predetermined or first position adjacent the top of the toner reservoir during each revolution of the stirring paddle. This causes the sensor to flex, and the sensor senses the mechanical stress created by its flexing. When the toner is engaged by the sensor, flexing of the sensor again occurs. The time between these two flexings of the sensor is utilized to determine the level of the powdered toner in the toner reservoir.

It is preferred that there be two fixed elements spaced a predetermined distance from each other at the predetermined or first position adjacent the top of the toner reservoir. Accordingly, when two relatively close electrical pulses are produced by two flexings of the sensor in a relatively short time period, this insures that the location of the stirring paddle at that time is known. Therefore, the time for the stirring paddle to move from engagement of the sensor with the second of the two fixed elements until the sensor engages the powdered toner is used to determine the level of the powdered toner in the toner reservoir.

If the stirring paddle is formed of a relatively flexible material having a physical memory such as polyethylene, for example, the sensor may be disposed on the stirring paddle so that the stirring paddle engages the fixed elements and the toner rather than the sensor. The sensor would sense each flexing of the stirring paddle.

Instead of using the two fixed elements at the predetermined or first position, an emitter wheel may be mounted on the shaft of the stirring paddle to indicate when the stirring paddle passes the predetermined or first position within the toner reservoir adjacent the top thereof. Thus, the first electrical signal would be produced by the emitter wheel with the stirring paddle at the first or predetermined position, which is the substantially vertical position of the stirring paddle. Then, the second electrical signal would be produced when the sensor or the stirring paddle, depending on the location of the sensor on the stirring paddle, engages the powdered toner. The time difference between these two electrical signals is employed to determine the level of the powdered toner in the toner reservoir.

An object of this invention is to provide an arrangement for continuously sensing the level of the toner in a toner reservoir.

Other objects of this invention will be readily perceived from the following description, claims, and drawings.

BRIEF DESCRIPTION OF THE DRAWINGS

The attached drawings illustrate preferred embodiments of the invention, in which.

DETAILED DESCRIPTION OF PREFERRED EMBODIMENTS

Figure 1:
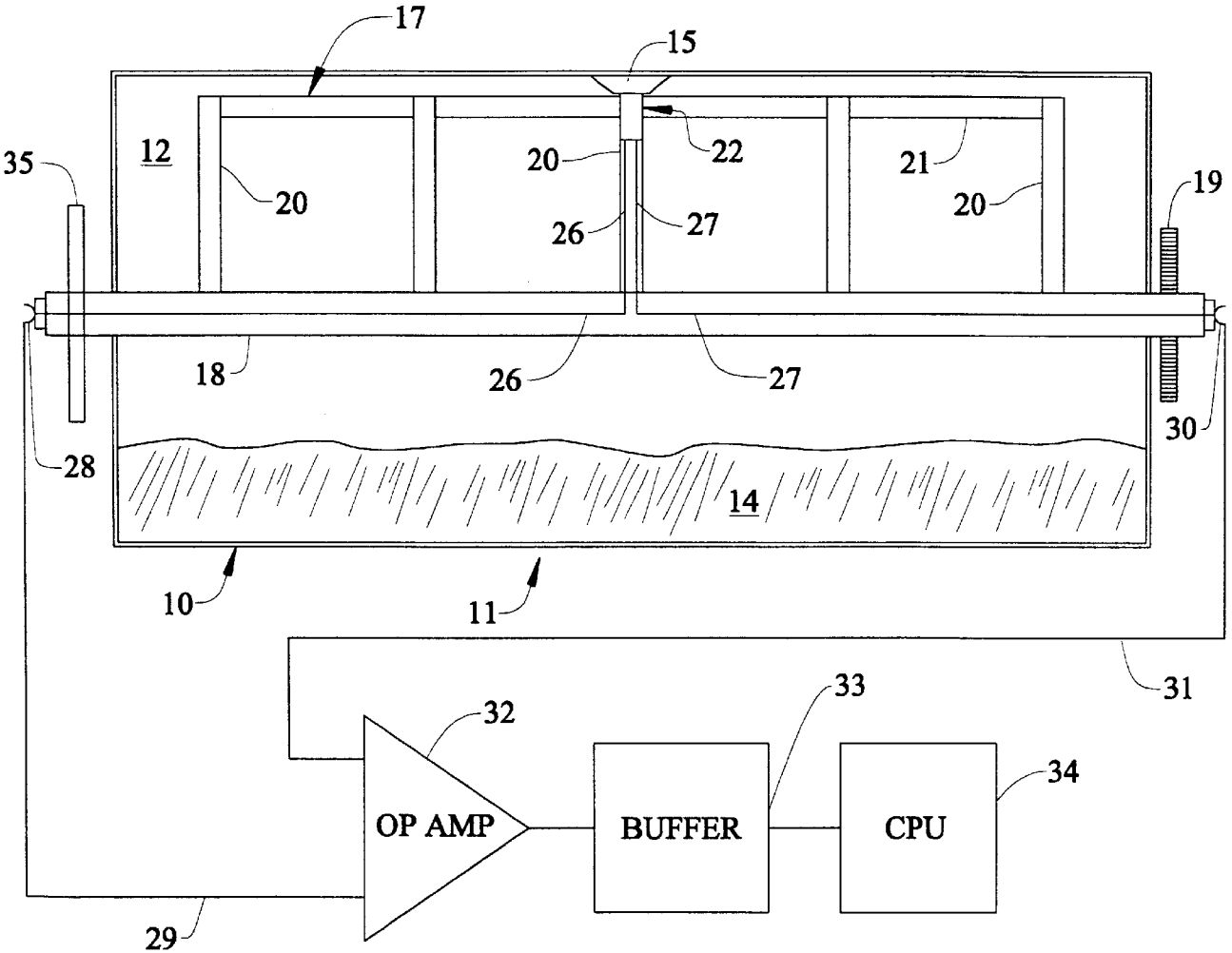
FIG. 1 is a schematic side elevational view of a toner reservoir of a cartridge of a printer including an electrical output circuitry.

Referring to the drawings and particularly FIG. 1, there is shown a removable cartridge 10 of a printer 11 such as a laser printer, for example. The removable cartridge 10 has a sealed toner reservoir 12 within which powdered toner 14 is disposed. The toner reservoir 12 is initially substantially filled with the powdered toner 14. Thus, FIGS. 1 and 2 disclose the powdered toner 14 at approximately half of its full level in the reservoir 12.

Figure 2:
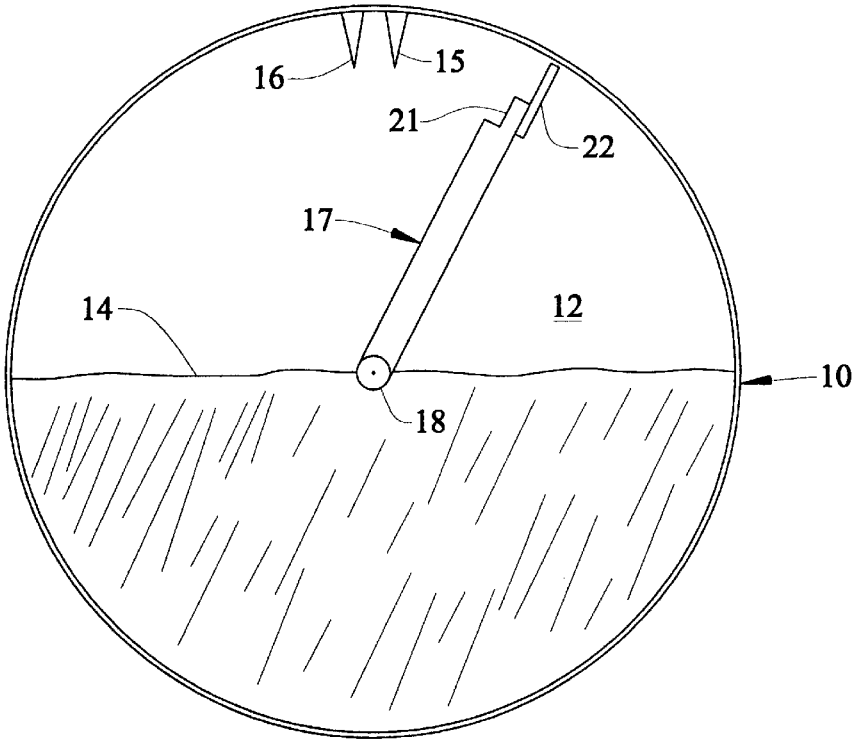
FIG. 2 is a schematic end elevational view of the toner reservoir of FIG. 1 with a stirring paddle approaching a predetermined or first position which is defined by two spaced homing ridges.

As shown in FIG. 2, two homing ridges 15 and 16 are supported in the toner reservoir 12 adjacent its top. The two homing ridges 15 and 16 are spaced a predetermined distance apart to constitute two fixed elements.

A stirring paddle 17 is mounted on a shaft 18 for rotation therewith. The shaft 18 (see FIG. 1) is driven from a motor (not shown) of the printer 11. The printer motor, which is preferably a DC or stepper motor, is external of the cartridge 10 and drives the shaft 18 through a gear train including a gear 19 on one end of the shaft 18.

The stirring paddle 17, which is a rotary element, includes a plurality of fingers 20 attached to the shaft 18 at spaced longitudinal portions thereof. The fingers 20 have their free ends joined to each other by a connector 21.

The fingers 20, the connector 21 , and the shaft 18 are preferably a single piece formed of a plastic such as molded polycarbonate, for example. Polycarbonate is a relatively rigid material.

The stirring paddle 17 may be formed of any other suitable material such as polyethylene, for example. Polyethylene is a flexible material having a physical memory so that it returns to its initial shape after each flexing.

Figure 5:
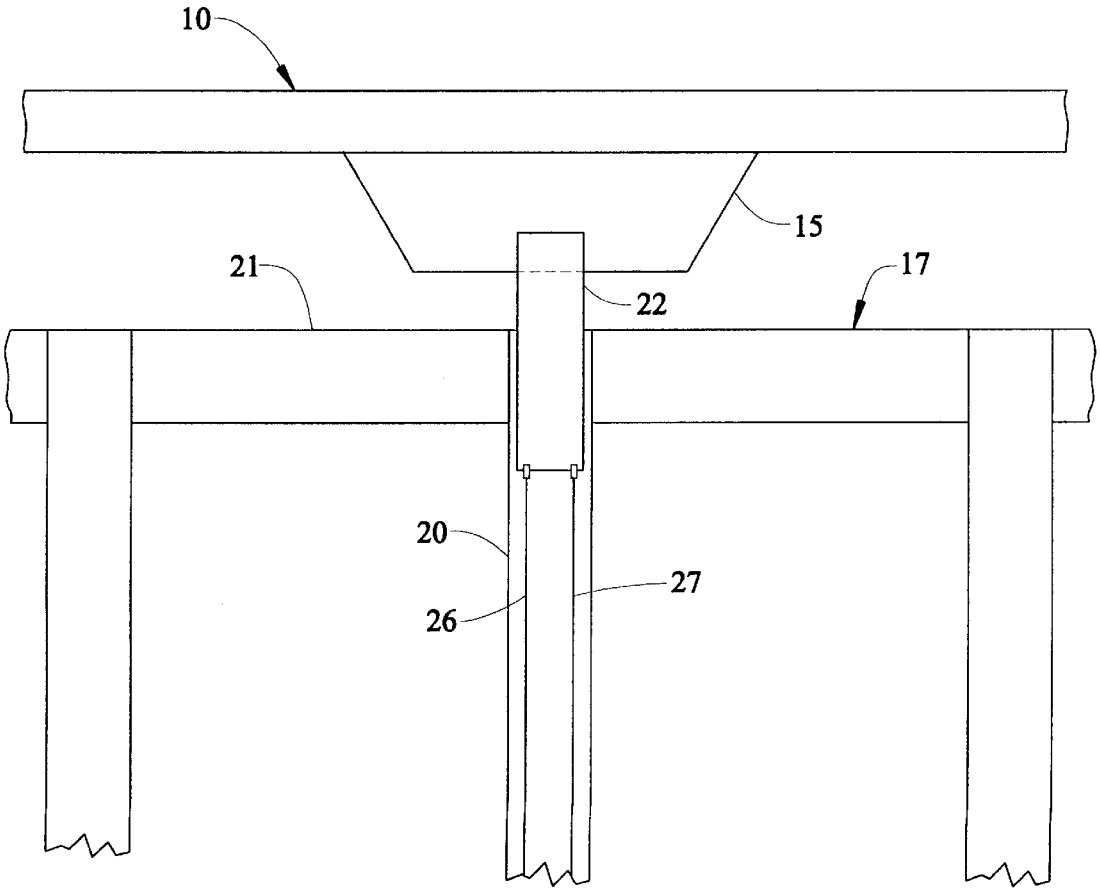
FIG. 5 is an enlarged fragmentary side elevational view of a portion of FIG. 1.

When the stirring paddle 17 is formed of a relatively rigid plastic such as polycarbonate, for example, a sensor 22, which is supported on the stirring paddle 17, must be capable of flexing. Thus, as shown in FIG. 5, the middle finger 20 of the stirring paddle 17 has the sensor 22 mounted thereon to extend beyond the outermost surface of the connector 21 of the stirring paddle 17. Accordingly, the sensor 22 is disposed to engage the homing ridges 15 and 16 (see FIG. 2) and the powdered toner 14 during each revolution of the stirring paddle 17.

When the stirring paddle 17 is formed of a flexible material having a physical memory such as polyethylene, for example, the stirring paddle 17 can flex. Therefore, the sensor 22 could be mounted on the stirring paddle 17 as shown in FIG. 3.

Figure 3:
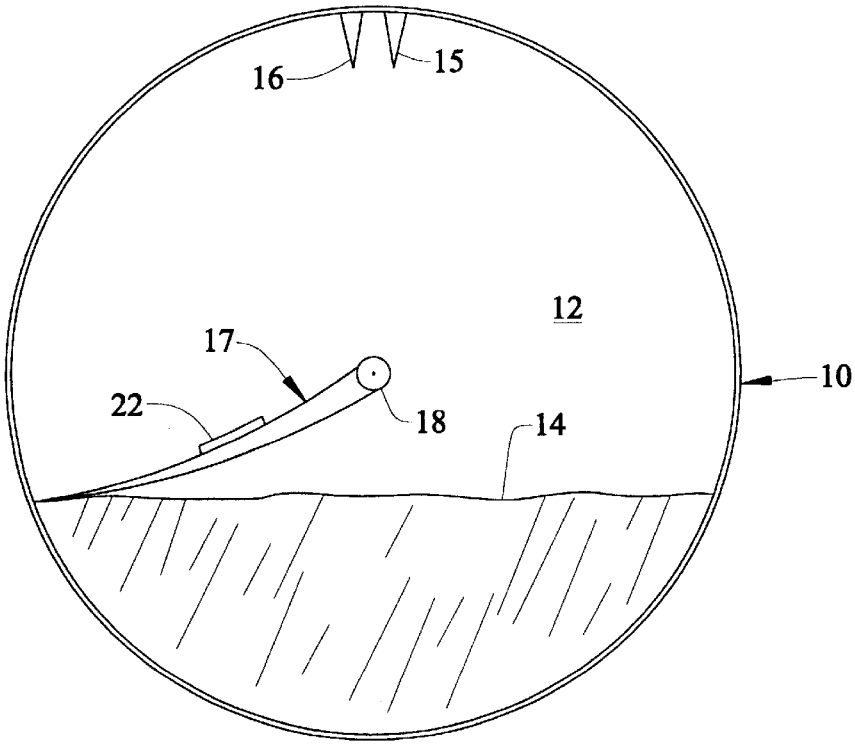
FIG. 3 is a schematic end elevational view, similar to FIG. 2, showing. a modification of the mounting position of the sensor on a flexible stirring paddle so that the stirring paddle engages the powdered toner in the toner reservoir.

In the arrangement of FIG. 3, the sensor 22 would sense flexing of the stirring paddle 17 when the stirring paddle 17 engages each of the homing ridges 15 and 16 during each revolution of the stirring paddle 17. Since the stirring paddle 17 makes the initial contact with the powdered toner 14 when the sensor 22 is mounted thereon as shown in FIG. 3, the sensor 22 senses the flexing of the stirring paddle 17 when the stirring paddle 17 engages the powdered toner 14.

Two suitable examples of the sensor 22 are a piezoelectric element and a strain gauge. Any other suitable element capable of producing an electric signal in response to the mechanical stress created by flexing of the sensor 22 or the stirring paddle 17 may be employed.

As the stirring paddle 17 is rotated counterclockwise (as viewed in FIG. 2), the sensor 22 measures the mechanical stress created by its flexing when the sensor 22 engages each of the homing ridges 15 and 16 or by flexing of the stirring paddle 17 when the stirring paddle 17 engages each of the homing ridges 15 and 16 depending on the location of the sensor 22 on the stirring paddle 17. The sensor 22 or the stirring paddle 17 also flexes when it engages the toner 14 in the reservoir 12. Accordingly, each time that there is flexing of the sensor 22 or the stirring paddle 17, the sensor 22 must be capable of producing an electrical signal to indicate this.

Figure 4:
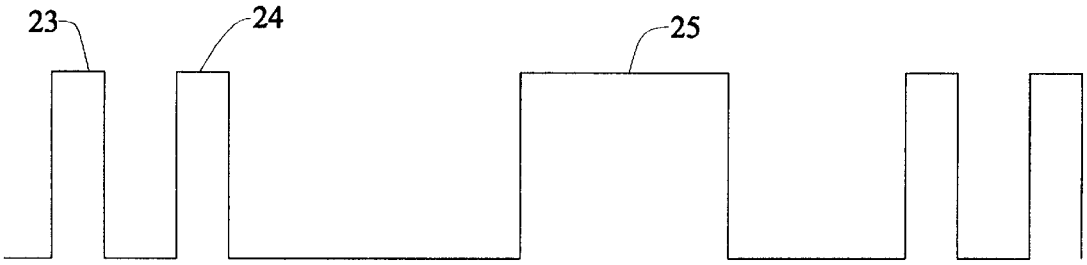
FIG. 4 is a schematic timing diagram showing the relationship of electrical pulses produced by the sensor due to one of the sensor and the stirring paddle engaging each of the homing ridges and the toner.

When the sensor 22 or the stirring paddle 17 engages the homing ridge 15, a first electrical pulse 23 (see FIG. 4) is produced. A second electrical pulse 24, which is relatively close to the first electrical pulse 23, is produced when the sensor 22 (see FIG. 2) or the stirring paddle 17 engages the homing ridge 16.

The counting of the time from when the stirring paddle 17 is at a predetermined or first position until the powdered toner 14 is engaged by the sensor 22 or the stirring paddle 17 begins with the rising edge of the second electrical pulse 24. Accordingly, the rising edge of the second electrical pulse 24 identifies the predetermined or first position when the two homing ridges 15 and 16 are employed.

When the sensor 22 or the stirring paddle 17 (see FIG. 3) engages the powdered toner 14 in the toner reservoir 12, a third electrical pulse 25 (see FIG. 4) is produced by the sensor 22 (see FIG. 3). The time between the rising edge of the second electrical pulse 24 (see FIG. 4) and the rising edge of the third electrical pulse 25 is utilized to determine the level of the powdered toner 14 (see FIG. 2) in the toner reservoir 12.

As shown in FIG. 5, electrical conductors 26 and 27 extend from one end of the sensor 22. The electrical conductor 26 connects through a wiper 28 (see FIG. 1) at one end of the shaft 18 to an electrical conductor 29. The electrical conductor 27 connects through a wiper 30 at the other end of the shaft 18 to an electrical conductor 31.

The electrical conductors 29 and 31 supply input signals to a single voltage operational amplifier 32. The output of the operational amplifier 32 is supplied to a buffer 33, which smoothes the shapes of the pulses 23 (see FIG. 4), 24, and 25. The pulses 23–25 flow from the buffer 33 (see FIG. 1) to a central processing unit (CPU) 34 of the printer 11.

Instead of employing the homing ridges 15 (see FIG. 2) and 16, an emitter wheel 35 (see FIG. 1) may be mounted on the opposite end of the shaft 18 from the gear 19. The emitter wheel 35 produces an electrical pulse when the position of the shaft 18 is such that the stirring paddle 17 is in a substantially vertical position in which the sensor 22 or the stirring paddle 17 would engage the homing ridge 16 if such were used. Thus, the electrical pulse produced by the emitter wheel 35 indicates the start of the timing period and corresponds to the pulse 24 in FIG. 4.

The CPU 34 (see FIG. 1) has a counter, for example, to count the time between the rising edge of the second electrical pulse 24 (see FIG. 4) and the rising edge of the third electrical pulse 25. When the emitter wheel 35 (see FIG. 1) is used, the same counter would be used for counting the time between the leading edge of the single electrical pulse produced from the emitter wheel 35 until the sensor 22 (see FIG. 3) or the stirring paddle 17 engages the powdered toner 14.

It should be understood that only one of the homing ridges 15 and 16 could be utilized, if desired. However, a false signal might be produced with only the pulse 23 (see FIG. 4) whereas the two relatively close pulses 23 and 24 enable the counter of the CPU 34 (see FIG. 1) to recognize that the stirring paddle 17 (see FIG. 2) is at its substantially vertical position.

While the time is obtained during each revolution of the stirring paddle 17, it should be understood that the level of the powdered toner 14 would be determined only after averaging the time from a predetermined number revolutions of the stirring paddle 17.

An advantage of this invention is that accurate measurement of the powdered toner level in a powdered toner reservoir of a printer or copier cartridge is obtained. Another advantage of this invention is that it is relatively inexpensive. A further advantage of this invention is that it has a self-cleaning sensor on the stirring paddle. Still another advantage of this invention is that it is capable of sensing all levels of the powdered toner in the toner reservoir.

For purposes of exemplification, preferred embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. A method of ascertaining the level of toner in a reservoir including:

rotating a rotary element in the reservoir and through the toner in the reservoir, said rotary element having mounted thereon a sensor which produces an electrical signal upon flexing of said sensor;

determining when the rotary element passes a first position in the reservoir during each revolution of the rotary element, said first position being out of said toner determining initial contact of said rotary element with said toner by monitoring said electrical signal from said sensor during revolution of the rotary element;

and determining the level of the toner in the reservoir in accordance with the time required for the rotary element to rotate from the first position until said initial contact revolution of the rotary element.

2. The method according to claim 1 including disposing at least one fixed element at the first position;

and disposing the sensor on the rotary element so that one of the rotary element and the sensor engages each of the at least one fixed element and the toner during each revolution of the rotary element.

3. The method according to claim 2 including providing a piezoelectric element on the rotary element as the sensor for sensing when one of the rotary element and the piezoelectric element engages each of the at least one fixed element and the toner.

4. The method according to claim 2 including disposing the sensor on the rotary element so that the sensor engages the at least one fixed element and the toner.

5. The method according to claim 2 including disposing the sensor on the rotary element for sensing a mechanical stress on the rotary element when the rotary element flexes due to the rotary element engaging each of the at least one fixed element and the toner.

6. The method according to claim 5 including providing a piezoelectric element as said sensor.

7. The method according to claim 1 including:

disposing two spaced fixed elements a predetermined distance apart to define the first position;

and determining when the rotary element passes the first position by sensing when one of the rotary element and the sensor engages the second of the two spaced fixed elements.

8. The method according to claim 7 including providing a piezoelectric element on the rotary element as the sensor for sensing when one of the rotary element and the piezoelectric element engages each of the two fixed elements and the toner.

9. The method according to claim 7 including disposing the sensor on the rotary element so that the sensor engages each of the two fixed elements and the toner.

10. The method according to claim 7 including disposing the sensor on the rotary element for sensing a mechanical stress on the rotary element when the rotary element flexes due to the rotary element engaging each of the two fixed elements and the toner.

11. The method according to claim 10 including providing a piezoelectric element as said sensor.

12. The method according to claim 1 including providing a piezoelectric element on the rotary element as the sensor for sensing when one of the rotary element and the piezoelectric element engages at least the toner.

13. The method according to claim 1 including disposing the sensor on the rotary element for sensing a mechanical stress on the rotary element to produce said electrical signal.

14. The method according to claim 13 including providing a piezoelectric element as said sensor.

15. A toner detecting device for detecting the level of toner in a reservoir of a cartridge for use with a printer or copier including:

a reservoir having toner therein;

a rotary element disposed within said reservoir for movement past a first position within said reservoir and through the toner in said reservoir during each revolution of said rotary, element said rotary element having mounted thereon a sensor which produces an electrical signal upon flexing of said sensor;

means to determine initial contact of said rotary element with said toner by monitoring said electrical signal from said sensor during revolution of the rotary element;

and determining means for determining the level of the toner in said reservoir during each revolution of said rotary element in accordance with the time required for said rotary element to rotate from the first position until said initial contact.

16. The device according to claim 15 including:

at least one fixed element supported at the first position in said reservoir;

one of said rotary element and said sensor engaging said at least one fixed element during each revolution of said rotary element;

and said determining means determining the time from when one of said rotary element and said sensor engages said at least one fixed element until one of said rotary element and said initial contact.

17. The device according to claim 16 in which said sensor includes a piezoelectric element mounted on said rotary element for determining when one of said rotary element and said piezoelectric element engages each of said at least one fixed element and the toner.

18. The device according to claim 16 in which said sensor includes a piezoelectric element mounted on said rotary element for sensing when one of said rotary element and said piezoelectric element engages at least the toner.

19. The device according to claim 16 in which said sensor is mounted on said rotary element for sensing a mechanical stress on said rotary element when said rotary element flexes due to its engagement with each of said at least one fixed element and the toner.

20. The method according to claim 19 including providing a piezoelectric element as said sensor.

21. The device according to claim 15 including:

two spaced fixed elements supported a predetermined distance apart to define the first position in said reservoir;

and said determining means determining the time for said rotary element to rotate from the first position until said initial contact.

22. The device according to claim 21 in which said sensor includes a piezoelectric element mounted on said rotary element for sensing when one of said rotary element and said piezoelectric element engages each of said two fixed elements and the toner.

23. The method according to claim 21 in which said sensor is mounted on said rotary element for sensing a mechanical stress on said rotary element when said rotary element flexes due to its engagement with each of the two fixed elements and the toner.

24. The method as in claim 23 including providing a piezoelectric element as said sensor.

25. The method according to claim 15 including disposing the sensor on the rotary element for sensing a mechanical stress on the rotary element to produce said electrical signal.

26. The method according to claim 25 including providing a piezoelectric element as said sensor.

* * * * *

UNITED STATES PATENT AND TRADEMARK OFFICE

CERTIFICATE OF CORRECTION

PATENT NO. : 6,100,601

DATED : August 8, 2000

INVENTOR(S) : Raymond Milton Baker; Ronald Paul Bussiere; John William Hutchinson It is certified that error appears in the above-identified patent and that said Letters Patent is hereby corrected as shown below:

| | |
|---|---|
| Claim 1, Col. 5, Line 50 | After "contact" insert -- during each --. |
| Claim 15, Col. 6, Lines 43-44 | Ignore the new paragraph shown after "each" and beginning with "revolution". |
| Claim 15, Col. 6, Line 44 | Delete "element" first occurrence. |
| Claim 20, Col. 7, Line 15 | Change "method" to read -- device --. |
| Claim 23, Col. 8, Line 9 | Change "method" to read -- device --. |
| Claim 24, Col. 8, Line 14 | Change "method" to read -- device --. |

UNITED STATES PATENT AND TRADEMARK OFFICE

CERTIFICATE OF CORRECTION

PATENT NO. : 6,100,601

DATED : August 8, 2000

INVENTOR(S) : Raymond Milton Baker; Ronald Paul Bussiere; John William Hutchinson It is certified that error appears in the above-identified patent and that said Letters Patent is hereby corrected as shown below:

| | |
|---|---|
| Claim 25, Col. 8, Line 16 | Change "method" to read -- device --. |
| Claim 26, Col. 8, Line 19 | Change "method" to read -- device --. |

Signed and Sealed this

Fifteenth Day of May, 2001

*Attest:*

Nicholas P. Godici

NICHOLAS P. GODICI

*Attesting Officer*

*Acting Director of the United States Patent and Trademark Office*